US009518542B2

(12) United States Patent
Rogler et al.

(10) Patent No.: US 9,518,542 B2
(45) Date of Patent: Dec. 13, 2016

(54) INJECTION VALVE

(71) Applicant: Robert Bosch GmbH, Stuttgart (DE)

(72) Inventors: Philipp Rogler, Stuttgart (DE); Martin Scheffel, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/426,433

(22) PCT Filed: Jul. 22, 2013

(86) PCT No.: PCT/EP2013/065372
§ 371 (c)(1),
(2) Date: Mar. 6, 2015

(87) PCT Pub. No.: WO2014/037142
PCT Pub. Date: Mar. 13, 2014

(65) Prior Publication Data

US 2015/0240765 A1 Aug. 27, 2015

(30) Foreign Application Priority Data

Sep. 6, 2012 (DE) ..... 10 2012 215 779

(51) Int. Cl.
*F02M 51/00* (2006.01)
*F02M 51/06* (2006.01)
*F02M 61/12* (2006.01)

(52) U.S. Cl.
CPC ..... *F02M 51/0675* (2013.01); *F02M 51/061* (2013.01); *F02M 51/066* (2013.01); *F02M 51/0685* (2013.01); *F02M 61/12* (2013.01)

(58) Field of Classification Search
CPC ..... F02M 51/0675; F02M 51/066; F02M 51/0685; F02M 61/12; F02M 51/061
(Continued)

(56) References Cited

U.S. PATENT DOCUMENTS 6,123,275 A * 9/2000 Geiger ..... F02M 51/0671 239/585.1
6,808,133 B1 * 10/2004 Stier ..... F02M 51/0614 239/585.1
(Continued)

FOREIGN PATENT DOCUMENTS

JP 2006-017101 A 1/2006
JP 2009-281291 A 12/2009
(Continued)

OTHER PUBLICATIONS

International Search Report for PCT/EP2013/065372, issued on Oct. 15, 2013.

*Primary Examiner* — Steven J Ganey
(74) *Attorney, Agent, or Firm* — Norton Rose Fulbright US LLP; Gerard Messina

(57) ABSTRACT

An injection valve is provided for injecting a medium, especially for injecting fuel into a combustion chamber, including: a housing having at least one spray orifice on a discharge side, a solenoid coil, a magneto armature, which is linearly movable by the solenoid coil, a linearly movable valve needle for opening and closing the spray orifice, a first stop on a side of the magneto armature facing away from the discharge side, and a second stop on a side of the magneto armature facing the discharge side, the magneto armature being linearly movable between the first stop and the second stop with respect to the valve needle, and a guide element which is joined to the valve needle, an outer area of the guide element serving as guide for the linear motion of the magneto armature, and the second stop being an integral part of the guide element.

11 Claims, 3 Drawing Sheets

(58) Field of Classification Search
USPC ..... 239/585.1–585.5
See application file for complete search history.

(56) References Cited

U.S. PATENT DOCUMENTS

| | | | | |
|---|---|---|---|---|
| 6,824,084 | B2 * | 11/2004 | Maier | F02M 51/0671 239/585.5 |
| 6,869,034 | B2 * | 3/2005 | Glaser | F02M 51/0685 239/585.1 |

FOREIGN PATENT DOCUMENTS

| | | | |
|---|---|---|---|
| KR | 100562874 | B1 | 3/2006 |
| KR | 1020090076099 | A | 7/2009 |
| WO | WO02/0668810 | | 9/2002 |
| WO | WO03/018994 | | 3/2003 |
| WO | WO2005/113973 | | 12/2005 |
| WO | WO2013/060717 | | 5/2013 |

* cited by examiner

INJECTION VALVE

FIELD OF THE INVENTION

The present invention relates to an injection valve for the injection of a medium, especially for the injection of fuel into a combustion chamber.

BACKGROUND INFORMATION

The related art describes valves for the injection of Otto fuel with the aid of a valve needle, which is moved by an actuator, e.g., a solenoid or piezo actuator, in opposition to a closing spring, in such a way that a desired fuel quantity is selectively introduced directly into the combustion chamber. In the case at hand, an injection valve is discussed, in which the magneto armature is decoupled from the valve needle. When the valve is opened, the magneto armature is to be rapidly released from the lower stop situated on the valve needle, rapidly overcome the free travel of the armature, and quickly open the valve when striking the upper stop. If the energy supply of the valve is cut off, the valve needle closes again. The magneto armature continues its movement once the valve needle seals the valve seat again, until it strikes the lower stop. The magneto armature bounces off the lower stop, once or multiple times as the case may be, until it reaches its neutral position again. The time until the magneto armature is reset to the neutral position is decisive for the ability of the valve to deliver injections that follow each other rapidly with high precision.

SUMMARY

The injection valve of the present invention allows very rapid resetting of the magneto armature after the valve has closed, by improved damping. This enables the injection valve to carry out very precise injections in rapid succession. As before, the armature free travel is adjustable. The switching behavior and the quantity metering of the injection valve are made uniform, and the actual values therefore deviate from the setpoint value as little as possible. The production cost of the valve needle is able to be reduced, since the magneto armature in the present invention is no longer guided on the valve needle but rather on the guide element. As a consequence, the valve needle no longer needs to be machined with the utmost precision. For example, grinding of the valve needle is dispensed with, or a rolled or drawn needle pin can be used without further postprocessing. All of these advantages are achieved by the injection valve of the present invention, which is used in Otto engines for a port injection or for a direct injection of fuel, in particular. The injection valve includes a housing having at least one spray orifice on a discharge side, a solenoid coil, and a magneto armature, which is linearly movable with the aid of the solenoid coil. Furthermore, a linearly movable valve needle for opening and closing the spray orifice is provided. The magneto armature is movable between a first stop and a second stop in a linear manner, coaxially with the valve needle. According to the present invention, the valve needle is fixedly connected to the guide element. The outer surface of the guide element serves as guide for the linear motion of the magneto armature. The second stop simultaneously is an integral part of the guide element. As a result, the guide of the magneto armature is integrally formed with the second stop. The first stop is situated on the side of the magneto armature facing away from the discharge side and may thus be called the upper stop. The second stop is situated on the side of the magneto armature facing the discharge side and thus may be called the lower stop. A squeezing gap is usually defined between the magneto armature and the second stop. The medium to be injected is situated in this squeezing gap, so that the squeezing gap dampens the movement of the magneto armature when the injection valve closes and rapidly resets the magneto armature to its neutral position. The effectiveness of the squeezing gap depends on the minimum gap height of the squeezing gap. In previously known injection valves, the second stop is situated on a stop sleeve. The stop sleeve in turn is welded to the valve needle. Tilting of the stop sleeve, and thus of the second stop as well, with respect to the valve needle takes place in this welding, which changes the gap height of the squeezing gap in a disadvantageous manner. In the present invention, this is avoided in that the guide element on which the second stop is developed is simultaneously used for guiding the magneto armature. As a result, a predefined angle between the second stop and the guide surface of the magneto armature is fixedly predefined and remains unchanged even during the welding operation.

The guide element is preferably developed as a sleeve placed on top of the valve needle. As an alternative, the guide element, as solid body, lengthens the valve needle in the longitudinal direction.

It is preferably provided that the first stop is formed on a ring. This ring is placed on the guide element. The ring is welded to the guide element, in particular. The clearance between the two stops minus the height of the magneto armature defines the armature free travel. It is adjusted by the positioning of the ring on the guide element.

The ring preferably has an L-shape in cross-section. The welding between ring and guide element is preferably implemented on the side of the first stop facing away from the discharge side.

The guide element is preferably welded to the valve needle. The welding seam is preferably applied only on the side of the second stop facing the discharge side.

Furthermore, it is preferably provided that the guide element is produced jointly with the second stop as a one-piece machined or milled part.

The second stop preferably projects at a right angle from the guide element.

The guide element in particular has a cylindrical outer surface, on which the magneto armature is guided.

DETAILED DESCRIPTION

Figure 1:
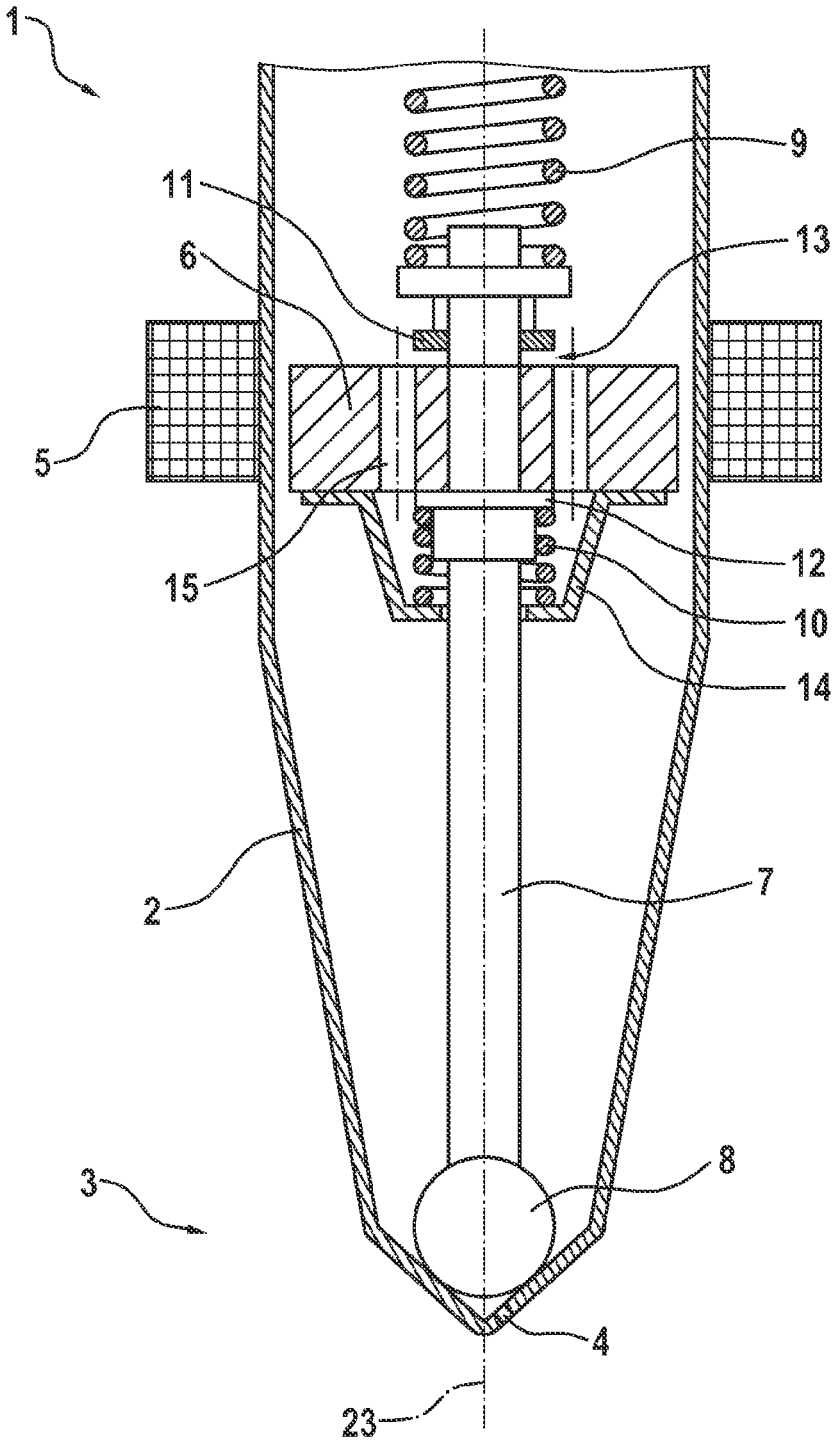
FIG. 1 shows an injection valve of the present invention according to all exemplary embodiments.

With the aid of FIGS. 1 and 2, an injection valve 1 according to the first exemplary embodiment is described in detail in the following text. Identical or functionally equivalent components have been provided with the same reference numerals in all exemplary embodiments.

Injection valve 1 includes a housing 2. In FIG. 1, housing 2 is shown only in part and in schematic form. At least one spray orifice 4 is developed in housing 2 on a discharge side of injection valve 1. Furthermore, housing 2 supports a solenoid coil 5.

In addition, injection valve 1 includes a magneto armature 6 and a valve needle 7 having a sphere 8.

Magneto armature 6 is linearly movable along a longitudinal axis 23 between first stop 11 and second stop 12. The distance between the two stops 11, 12 defines an armature free travel 13. A first spring 9 loads valve needle 7 in the direction of discharge side 3. A second spring 12 [sic; 10] is linked to magneto armature 6 via a spring cup 14. Second spring 10 also loads magneto armature 6 in the direction of discharge side 3 via spring cup 14, so that magneto armature 6 rests against second stop 12 by the force of second spring 10.

Channels 15 through which the fuel to be injected is able to flow are developed inside magneto armature 6. In addition or as an alternative to channels 15, valve needle 7 may also be developed as a hollow needle.

Figure 2:
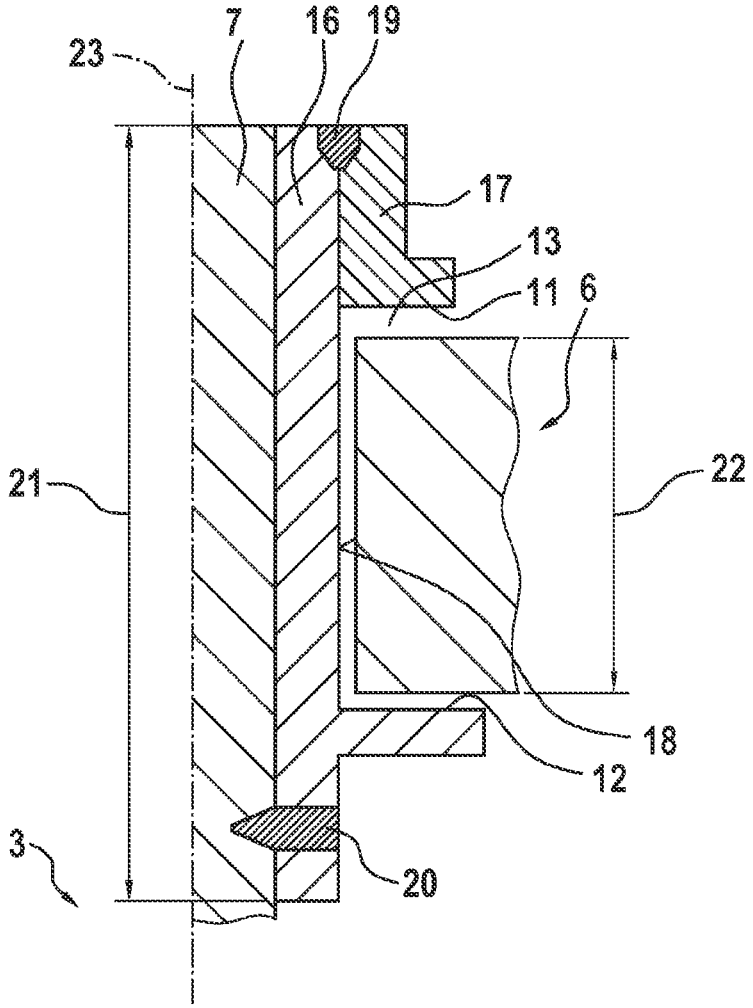
FIG. 2 shows a detail of the injection valve of the present invention according to a first exemplary embodiment.

FIG. 2 shows a detail cutaway of injection valve 1. FIG. 2 clearly shows that a guide element 16, which is developed as sleeve 16, is situated on valve needle 7. An integral part of guide element 16 is second stop 12. Guide element 16 together with second stop 12 is produced as a one-piece lathe-cut component. Guide element 16 extends across a guide element length 21. Magneto armature 6 extends across a magneto armature length 22. The lengths are measured parallel to longitudinal axis 23. Guide element length 21 is considerably longer than magneto armature length 22. This makes it possible for guide element 16 to fully guide magneto armature 12 by its outer area 18. Because of the integral development of second stop 12 on guide element 16, a defined angle, especially of 90°, is provided between outer area 18 and second stop 12.

A ring 17 is situated on guide element 16. First stop 11 is formed on ring 17. Ring 17 has an L-shaped form in cross-section. A first welding seam 19 connects ring 17 to guide element 16. Guide element 16 in turn is connected to valve needle 7 by means of a second welding seam 20.

Figure 3:
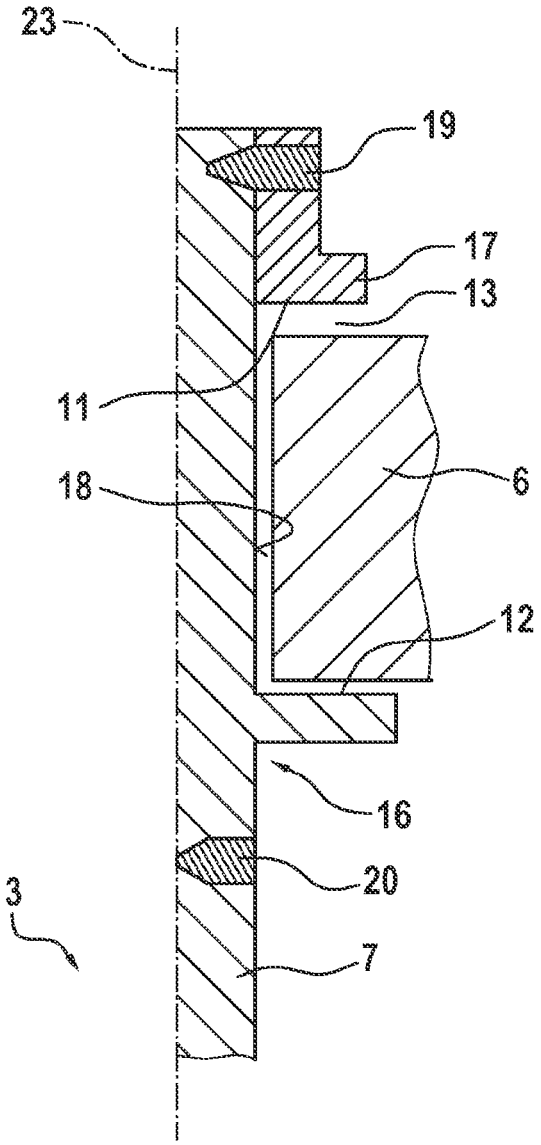
FIG. 3 shows a detail of the injection valve of the present invention according to a second exemplary embodiment.

FIG. 3 shows a detail of a second exemplary embodiment. In the second exemplary embodiment, guide element 16 is not developed in the form of a sleeve, but as solid body. Valve needle 7 ends below guide element 16. Guide element 16 lengthens valve needle 7 along longitudinal axis 23 at least up to ring 17.

In both exemplary embodiments, guide element 16 of the present invention therefore combines the guidance and stop functions. The exemplary embodiments are able to be built using a hollow or a solid valve needle 7, which generally need not be symmetrical. Ring 17 [is] connected to sleeve 16 via first welding seam 19, the desired armature free travel 13 being adjustable here in a cost-effective manner by shifting ring 17.

Guide element 16 is preferably developed in such a way that outer area 18, which assumes the guidance, and the surface of second stop 12 which is situated at a right angle thereto, are able to be produced in a single clamping setup, such as turned and/or ground. Welding seams 19, 20 are preferably situated at a distance from the guide and stop surface in such a way that these areas will not be distorted by the welding process.

What is claimed is:

1. An injection valve for an injection of a medium, comprising:

a housing having at least one spray orifice on a discharge side;

a solenoid coil;

a magneto armature which is linearly movable by the solenoid coil;

a linearly movable valve needle for opening and closing the spray orifice;

a first stop on a side of the magneto armature and facing away from the discharge side;

a second stop on a side of the magneto armature facing the discharge side, the magneto armature being linearly movable with respect to the valve needle between the first stop and the second stop;

a guide element connected to the valve needle, wherein an outer area of the guide element serves as a guide for a linear motion of the magneto armature, and wherein the second stop is an integral part of the guide element.

2. The injection valve as recited in claim 1, wherein the injection valve is for an injection of fuel into a combustion chamber.

3. The injection valve as recited in claim 1, wherein the guide element is a one-piece turned or milled part together with the second stop.

4. The injection valve as recited in claim 1, wherein the second stop projects at a right angle from the guide element.

5. The injection valve as recited in claim 1, wherein one of the guide element is a sleeve which is placed on the valve needle, and the guide element is an element that lengthens the valve needle.

6. An injection valve for an injection of a medium, comprising:

a housing having at least one spray orifice on a discharge side;

a solenoid coil;

a magneto armature which is linearly movable by the solenoid coil;

a linearly movable valve needle for opening and closing the spray orifice;

a first stop on a side of the magneto armature and facing away from the discharge side; a second stop on a side of the magneto armature facing the discharge side, the magneto armature being linearly movable with respect to the valve needle between the first stop and the second stop;

a guide element connected to the valve needle, wherein an outer area of the guide element serves as a guide for a linear motion of the magneto armature, and wherein the second stop is an integral part of the guide element and a ring placed on the guide element, wherein the first stop is formed on the ring.

7. The injection valve as recited in claim 6, wherein the ring is welded to the guide element.

8. The injection valve as recited in claim 6, wherein the ring has an L-shaped cross-section.

9. The injection valve as recited in claim 6, wherein the ring is welded to the guide element only on a side of the first stop facing away from the discharge side.

10. The injection valve as recited in claim 6, wherein the guide element is welded to the valve needle.

11. The injection valve as recited in claim 10, wherein the guide element is welded to the valve needle only on a side of the second stop facing the discharge side.

* * * * *